US010343430B2

(12) United States Patent
Musete

(10) Patent No.: US 10,343,430 B2
(45) Date of Patent: Jul. 9, 2019

(54) ASSEMBLY FOR MOVING A CARRIAGE

(71) Applicant: Océ Holding B.V., Venlo (NL)

(72) Inventor: Romeo Musete, New Westminster (CA)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/699,761

(22) Filed: Sep. 8, 2017

(65) Prior Publication Data

US 2018/0079240 A1 Mar. 22, 2018

(30) Foreign Application Priority Data

Sep. 22, 2016 (EP) ..... 16190043

(51) Int. Cl.

| | |
|---|---|
| ***B41J 25/00*** | (2006.01) |
| ***B41J 2/175*** | (2006.01) |
| ***B41J 19/00*** | (2006.01) |
| ***B41J 19/06*** | (2006.01) |

(52) U.S. Cl.

CPC ..... *B41J 25/001* (2013.01); *B41J 2/175* (2013.01); *B41J 19/005* (2013.01); *B41J 19/06* (2013.01)

(58) Field of Classification Search

CPC ..... B41J 19/04; B41J 29/10; B41J 19/06
See application file for complete search history.

(56) References Cited

U.S. PATENT DOCUMENTS 5,043,746 A * 8/1991 Abe ..... 248/68.1
6,113,217 A * 9/2000 Araki ..... B41J 29/02 347/50
6,338,553 B1 * 1/2002 Lewis ..... B41J 2/175 347/85
6,755,514 B2 * 6/2004 Koga ..... B41J 2/175 347/85
2002/0070996 A1 * 6/2002 Feiner ..... B41J 2/175 347/37
2007/0252875 A1 * 11/2007 Samoto ..... B41J 2/175 347/85

(Continued)

FOREIGN PATENT DOCUMENTS

JP 02004562 A * 1/1990 ..... B41J 29/00
JP 02004563 A * 1/1990 ..... B41J 29/00

(Continued)

OTHER PUBLICATIONS

Machine generated English translation of JP2006-159603 to Mikoshiba, "Image Forming Apparatus"; retrieved via https://www4.j-platpat.inpit.go.jp/cgi-bin/tran_web_cgi_ejje?u=http://www4.j-platpat.inpit.go.jp/eng/translation/201809150416289677736764372759477AC6B2AA27C99038102A29C497D09D9B5 on Sep. 15, 2018; 4 pp.*

(Continued)

*Primary Examiner* — Shelby L Fidler
(74) *Attorney, Agent, or Firm* — Birch, Stewart, Kolasch & Birch, LLP

(57) ABSTRACT

An assembly is provided for moving a carriage, the assembly comprising a carriage beam arranged for supporting the carriage, which is moveably arranged along the carriage beam, a cable carrier for supporting a cable, the cable carrier being attached to the carriage and comprising a plurality of carrier segments distributed along a length of the cable carrier, and a flexible support element arranged along the carriage beam for supporting the cable carrier along a track.

19 Claims, 4 Drawing Sheets

(56) References Cited

U.S. PATENT DOCUMENTS

| | | | | |
|---|---|---|---|---|
| 2008/0049087 | A1* | 2/2008 | Morino | B41J 2/175 347/101 |
| 2008/0111869 | A1* | 5/2008 | Kumagai | B41J 2/175 347/85 |
| 2009/0066750 | A1* | 3/2009 | Beltman | B41J 3/28 347/37 |
| 2013/0278674 | A1 | 10/2013 | Ota | |

FOREIGN PATENT DOCUMENTS

| | | | | |
|---|---|---|---|---|
| JP | 2000-318176 | A | | 11/2000 |
| JP | 2006159603 | A | * | 6/2006 |
| JP | 2010-240927 | A | | 10/2010 |
| WO | WO 2014/092140 | A1 | | 6/2014 |

OTHER PUBLICATIONS

Search Report issued in European priority application 16190043, dated Mar. 2, 2017.

* cited by examiner

Fig. 1A
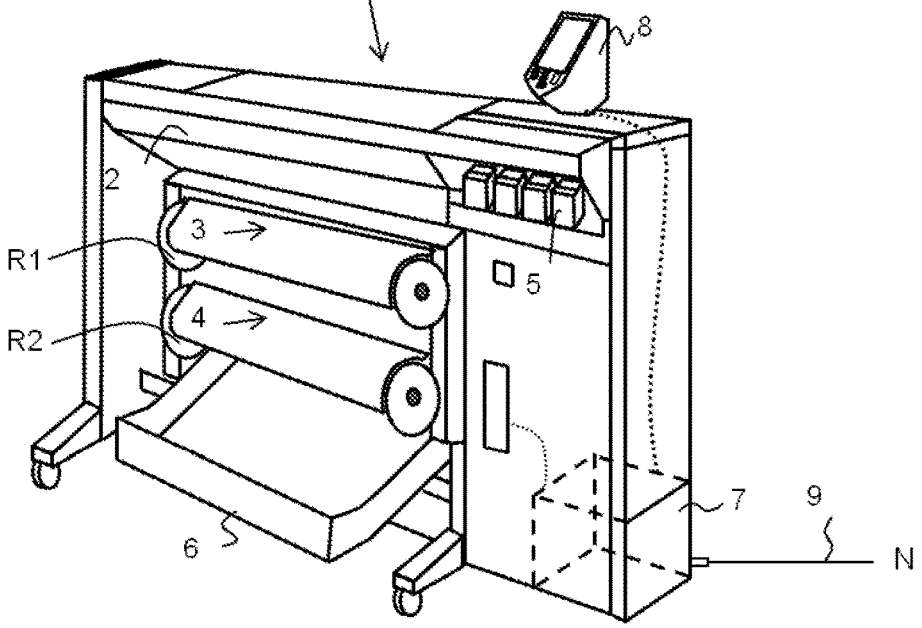
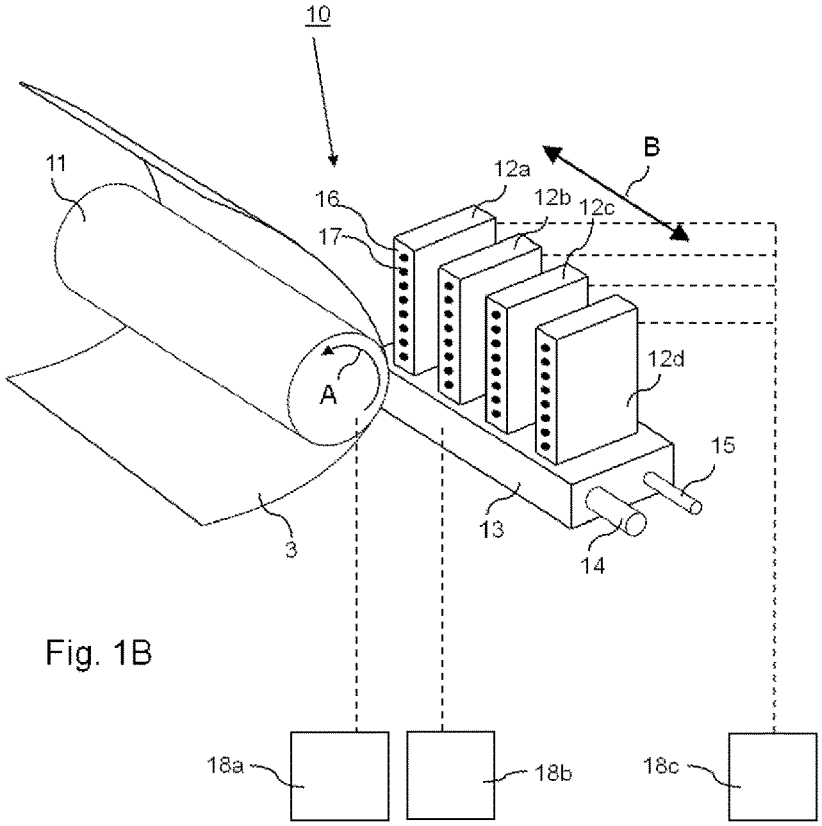
Fig. 1B

ASSEMBLY FOR MOVING A CARRIAGE

FIELD OF THE INVENTION

The present invention pertains to an assembly for moving a carriage. The present invention further pertains to an apparatus comprising the assembly according to the present invention.

BACKGROUND ART

In a known assembly for moving a carriage, the assembly comprises a carriage beam, which is arranged for supporting the carriage. The carriage beam extends along a longitudinal direction. The carriage is moveably arranged along the carriage beam in the longitudinal direction. The assembly further comprises a cable carrier for supporting a cable. The cable carrier is attached to the carriage, such as being attached to the carriage at a first end of the cable carrier. In examples, the cable may comprise a wire for communicating electrical power and/or electrical signals towards the carriage and may comprise a tube for communicating a fluid or a gas towards the carriage.

The cable carrier comprises a plurality of carrier segments distributed along a length of the cable carrier. The plurality of carrier segments provides flexibility to the cable carrier along its length such that the cable carrier may move together with the carriage, while the carriage moves along the carriage beam. The cable carrier moves along with the carriage by bending in a looping shape.

The cable carrier is partly supported by an elongated support plate. While the carriage moves along the carriage beam, the cable carrier is in rolling contact to the elongated support plate along a track, which is substantially parallel to the longitudinal direction of the carriage beam. The elongated support plate, the carriage beam or both are fixed to a frame.

When the cable carrier rolls on the elongated support plate along the track, the plurality of carrier segments contacting the support plate generate a dynamic vibration inside the cable carrier and inside the elongated support plate. The dynamic vibrations may propagate towards the carriage via the cable carrier and/or from the support plate via the frame and the carriage beam. As a consequence the position of the carriage is disturbed by the dynamic vibrations.

This is especially disadvantageous in case a processing unit is mounted onto the carriage and the position of the processing unit is important for processing, such as in an apparatus having a processing unit, which comprises a print head assembly for printing an image on a substrate.

Further, the vibrations, specifically their frequency and/or intensity, need not be constant or may vary by per device. This may for example be due to the speed with which the carriage moves over the beam or due to differences during the assembly of a device.

It is an object to provide an assembly for moving a carriage, the assembly comprising a cable carrier comprising a plurality of carrier segments, wherein dynamic vibrations of the cable carrier are reduced in a simple way.

SUMMARY OF THE INVENTION

In an aspect of the present invention an assembly is provided for moving a carriage, the assembly comprising a carriage beam arranged for supporting the carriage, which is moveably arranged along the carriage beam, a cable carrier for supporting a cable, the cable carrier being attached to the carriage and comprising a plurality of carrier segments distributed along a length of the cable carrier, and a flexible support element arranged along the carriage beam for supporting the cable carrier along a track.

The flexible support element supports the cable carrier along the track. When the cable carrier rolls on the flexible support element along the track in response to a movement of the carrier, a plurality of carrier segments successively contact the flexible support element. Any dynamic vibrations caused by the moving contact of the plurality of carrier segments to the support element are damped by the flexible support element. In particular, the flexibility of the support element may be selected to provide a compliancy to the dynamic vibrations. As the support element is made flexible, it provides a simple solution to reduce dynamic vibrations caused by the cable carrier.

The carrier segments may comprise a solid body and two connecting portions, each connecting portion being mounted to the solid body for connecting the carrier segment to another, adjacent, carrier segment. The connecting portion, such as a hinge, is configured to provide flexibility of one carrier segment relative to another, connected, carrier segment in at least one direction, such as a hinge supporting a rotation of a first carrier segment with respect to a second carrier segment around a pivot axis, e.g. a pivot axis provided by a pivot pin.

Each of the carrier segments, including the connecting portions, may be configured to restrict a movement of the cable carrier in a transverse direction perpendicular to the carriage beam, i.e. perpendicular to a movement of the carrier along the carriage beam. In an example, the material of the solid body is selected to be stiff, such as a metal or a stiff plastic material, so to restrict a movement of the cable carrier in the transverse direction. As such, the plurality of carrier segments is configured to restrict a rocking movement of the cable carrier in the transverse direction perpendicular to the carriage beam. In this way, the cable carrier prevents or at least reduces a rocking movement in the transverse direction perpendicular to the carriage beam.

The cable carrier may be connected to the carriage at one of its ends along the length of the cable carrier. This arrangement supports a reliable connection of the cable carrier to the carriage. Additionally or alternatively, the cable carrier may be connected to the flexible support element at another one of its ends along the length of the cable carrier. This arrangement supports a reliable connection of the cable carrier to the flexible support element and supports the rolling contact of the cable carrier along the track.

In an example, the cable carrier may be connected to the flexible support element at a connecting point arranged substantially centered with respect to the carriage beam. In this arrangement, the cable carrier may be in rolling contact to the flexible support element along a track, which extends to both sides of the connecting point. In general, the track will extend substantially half to the left and substantially half to the right of the centered connecting point.

Alternatively, the cable carrier may be connected to the flexible support element at a connecting point arranged off-centered with respect to the carriage beam. In this arrangement, the cable carrier may be in rolling contact to the flexible support element along a track, which extends to one side or both sides of the connecting point, depending on a movement of the carriage with respect to the off-centered connecting point.

In an example, a flexible support element may be suitably selected based on a mechanical attribute of the plurality of carrier segments, such as stiffness or weight of the plurality of carrier segments, and/or based on a moving condition of the moving carriage in order to effectively damp any dynamic vibrations.

The assembly further comprises a tensioner assembly arranged for tensioning the flexible support element. The tensioner assembly controls the tension of the flexible support element. The tensioner assembly may be attached to the flexible support element at one end of the flexible support element along the carriage beam. Thereby, a desired tension may be applied to the flexible support element to reduce the vibrations. The adjusting mechanism provides a versatile means for eliminating vibrations, as it allows the flexible support to be tuned for each specific operating condition or device. Thereby the object of the present invention has been achieved.

More specific optional features of the invention are indicated in the dependent claims.

In an embodiment, a first end of the metal belt is attached to a first mounting plate of a frame and a second end of the flexible support element (e.g. a metal belt) is attached to a second mounting plate of the frame. The mounting plates are provided on opposite ends of the frame, such that the flexible support element extends between them in a direction substantially parallel to the carriage beam. Preferably, a first holder is mounted on the first mounting plate for holding the first end of the flexible support element and a second holder is mounted on the second mounting plate for holding the second end of the flexible support element. The holders engage and securely hold the flexible support when in use. Preferably, the first holder and the second holder are mounted on an opposite sides of the frame when viewed along a longitudinal direction of the carriage beam.

In an embodiment, the tensioner assembly further comprises an adjusting mechanism for adjusting the tension in the flexible support element. This arrangement supports a simple control on the tension of the flexible support element. The tensioner assembly may comprise at least one tension adjusting spring element, such as a coil spring, and an adjusting mechanism arranged for controlling the spring element to adjust the tension. Alternatively, the adjusting mechanism comprises positioning means for adjusting and setting a distance between the first and the second holder. As such, the tension in the flexible support element may be tuned to the present condition of the printing system to compensate for operational or structural changes, such as wear or hardware upgrades.

In an embodiment, the flexible support element is a belt. The belt is longitudinally elastic. The belt during use is secured at both ends. In order to vibrate to dampen the vibrations, the belt requires a degree of freedom, which is provided by using a longitudinally flexible belt. Even when secured between two fixed points, the belt is able to vibrate. The tensioner assembly sets the longitudinal tension in the elastic belt in compliance with the frequency or frequencies of the undesired vibrations.

In an embodiment, the assembly further comprises the cable and the cable carrier is arranged co-extensive to the cable along a length direction of the cable. In examples, the cable may comprise a wire for communicating electrical power and/or electrical signals towards the carriage and may comprise a tube for communicating a fluid or a gas towards the carriage. The cable-carrier is arranged co-extensive to the cable. In this way, the cable carrier is arranged for supporting the cable along the length direction of the cable.

The cable carrier may be arranged to accommodate the cable, such as by enclosing the cable. As such, the cable carrier is arranged for guiding the cable, thereby restricting the movement of the cable.

In an example, each of the carrier segments comprises a hollow body shaped to accommodate the cable and/or to guide the cable. In another example, each of the carrier segments comprises parallel side elements jointed by parallel cross bars mounted on bottom and top of the side elements.

In a further embodiment, the cable carrier may be arranged to enclose a plurality of cables.

In an embodiment, the cable carrier is connected to the carriage at a first end of the cable carrier and is connected to the flexible support element at a second end of the cable carrier. This arrangement supports a reliable connection of the cable carrier to the carriage and to the support element and supports the rolling contact of the cable carrier along the track. The track extends along the flexible support element from the fixed position of the second end of the cable up to a loop of the cable carrier, where the cable carrier curves away from the flexible support element. The loop of the cable carrier will move along a length of the cable carrier in response to a movement of the carriage, such as a reciprocating movement, along the carriage beam. As a result, the track may be extended and shortened, respectively, depending on the movement of the carriage along the carriage beam.

In an embodiment, a compliancy of the flexible support element is configured for damping a dynamic vibration of the cable carrier. The compliancy of the flexible support element may be selected by suitably selecting a flexible material of the support element. The compliancy of the flexible support element enables damping of the dynamic vibration of the cable carrier. In an example, the compliancy of the support element may be suitably selected based on a mechanical attribute of the plurality of carrier segments, such as stiffness or weight of the plurality of carrier segments, and/or based on a moving condition of the moving carriage in order to effectively damp any dynamic vibrations. For example, when the carriage is operated to move along the carriage beam in a predetermined movement, such as a reciprocating movement having a predetermined velocity, the compliancy may be selected to match the dynamic vibration caused by the predetermined movement of the carriage. In particular, the frequency response and/or vibration amplitude of the flexible support element may be adapted to the dynamic vibration of the cable carrier.

In an embodiment, the flexible support element is constituted by a metal belt. The metal belt provides a simple and durable flexible support element having a known compliancy. Furthermore, the metal belt provides a simple support element, which can easily be mounted to the assembly to extend along the carriage beam at a suitable distance from the carriage beam for supporting the cable carrier.

Furthermore, the compliancy of the metal belt may easily be adjusted by controlling a tension of the metal belt, such as a tension applied to the metal belt in a direction along the carriage beam.

The assembly may further comprise a support bar extending along the metal belt for mounting the metal belt at both ends of the metal belt. The support bar is arranged for maintaining the metal belt substantially stationary with respect to the cable carrier. Furthermore, the support bar enables a tension control of the metal belt. In an embodiment, a compliancy of the flexible support element is adaptable by the tensioner assembly such to affect a resonance frequency and/or resonance amplitude of the flexible support element. The flexible support element of this embodiment is made of a material, wherein the compliancy of the flexible support element depends on the tension of the flexible support element. In an example, a metal belt is a simple flexible element, which has a compliancy which depends on the tension of the metal belt.

The resonance frequency may be increased or decreased by adjusting the tension of the flexible support element, likewise to a resonance frequency of a guitar string, which depends on the tension of the guitar string. Additionally or alternatively, the resonance amplitude of the flexible support element may be adjusted by adjusting the tension of the flexible support element.

This embodiment is advantageous for adjusting the compliancy to correct for aging of the assembly, such as changing material properties of the cable carrier or changing resilience properties of the flexible support element. Furthermore, the embodiment is advantageous for adjusting the compliancy to correct for changing dynamic vibrations of the cable carrier, such as due to different environmental conditions, e.g. different temperature or humidity.

In an embodiment, the assembly further comprises a control unit operatively connected to the tensioner assembly for controlling the tension of the flexible support element. The control unit controls the tensioner assembly for controlling the tension of the flexible support element. The control unit supports a reliable and control on the compliancy of the flexible support element. In particular, the tensioner assembly may comprise at least one spring element, such as a coil spring, and an adjusting mechanism arranged for controlling the spring element to adjust the tension; and the control unit is operatively connected to the adjusting mechanism for controlling the spring element.

In an embodiment, the control unit is arranged to control the tension of the flexible support element based on a movement of the carriage along the carriage beam. The control unit may additionally be operatively connected to an actuator for moving the carriage along the carriage beam. As the control unit controls the movement of the carriage, the control unit may accurately control a compliancy of the flexible support element by adjusting the tension of the flexible support element. For example, the control unit may adjust the tension of the flexible support element in response to an estimate of the dynamic vibration of the cable carrier based on the known movement of the carriage along the carriage beam.

In an embodiment, the assembly further comprises at least one spring element arranged for mounting the cable carrier to the carriage. The at least one spring element restrict a transmission of the dynamic vibration of the cable carrier to the carriage, such as by preventing or restricting the transmission of the vibration of the cable carrier at its end, which is connected to the carriage via the at least one spring element.

In a particular embodiment a pair of spring elements is arranged for mounting the cable carrier to the carriage, which comprises a first spring element and a second spring element both being connected at a first position to the cable carrier and wherein the first spring element is arranged at an acute angle with respect to the second element. In an example the acute angle is about 45 degrees. The pair of spring elements provides mounting of the cable carrier to the carriage, while at the same time damping any vibrations of the cable carrier and damping any up-down motions or side to side motions of the cable carrier.

In an embodiment, the assembly further comprises two side mounting plates, each side mounting plate being arranged for mounting the carriage beam and arranged for mounting the flexible support element. The arrangement supports a simple and accurate assembling of the carriage beam together with the flexible support element, while the flexible support element prevents any transmission of the dynamic vibration of the cable carrier to the carriage, which is mounted on the carriage beam.

In another aspect of the present invention an apparatus is provided comprising the assembly according to anyone of the preceding claims, wherein the apparatus comprises a processing unit which is mounted on the carriage and wherein the apparatus further comprises a control unit for controlling the processing unit by way of the cable. The processing unit provides a processing operation, such as a print head assembly for printing an image on a substrate or a cutting assembly for cutting a substrate. The carriage moves the processing unit along the carriage beam to arrange the processing unit at a desired position along the carriage beam. The control unit is arranged, such as mounted on a frame of the apparatus, for controlling the processing unit by way of the cable. In an example, electrical power and/or electrical signals are provided by the control unit to the processing unit through the cable, which is supported by the cable carrier. In a particular example, the control unit controls the processing unit by using a plurality of cables, which are supported by the cable carrier. In this way, the weight of the carriage including the processing unit is reduced by mounting the control unit on the apparatus away from the carriage.

In an embodiment, the apparatus is a printing apparatus and wherein the processing unit is a print head assembly for printing an image on a substrate. The assembly for moving the carriage according to the present invention prevents transmission of dynamic vibrations of the cable carrier to the print head assembly, which is mounted on the carriage. In this way, accurate and reliable image forming on the substrate is supported by the printing apparatus according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIGS. 1A-1B show an image forming apparatus 1, wherein printing is achieved using a wide format inkjet printer.

DETAILED DESCRIPTION OF THE DRAWINGS

Figure 2A:
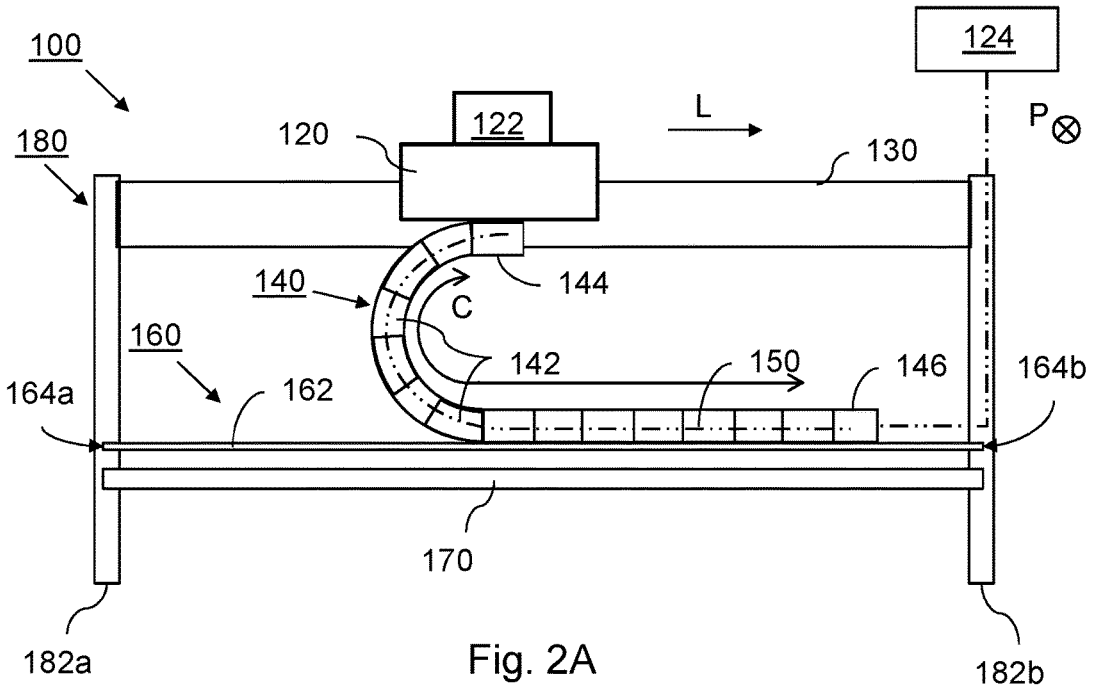
FIGS. 2A and 2B show schematically an embodiment of an assembly for moving a carriage according to the present invention.

The present invention will now be described with reference to the accompanying drawings, wherein the same reference numerals have been used to identify the same or similar elements throughout the several views.

FIG. 1A shows an image forming apparatus 1, wherein printing is achieved using a wide format inkjet printer. The wide-format image forming apparatus 1 comprises a housing 2, wherein the printing assembly, for example the ink jet printing assembly shown in FIG. 1B is placed. The image forming apparatus 1 also comprises a storage means for storing image receiving member 3, 4, a delivery station to collect the image receiving member 3, 4 after printing and storage means 5 for marking material. In FIG. 1A, the delivery station is embodied as a delivery tray 6. Optionally, the delivery station may comprise processing means for processing the image receiving member 3, 4 after printing, e.g. a folder or a puncher. The wide-format image forming apparatus 1 furthermore comprises means for receiving print jobs and optionally means for manipulating print jobs. These means may include a user interface unit 8 and/or a control unit 7, for example a computer.

Images are printed on an image receiving member, for example paper, supplied by a roll 3, 4. The roll 3 is supported on the roll support R1, while the roll 4 is supported on the roll support R2. Alternatively, cut sheet image receiving members may be used instead of rolls 3, 4 of image receiving member. Printed sheets of the image receiving member, cut off from the roll 3, 4, are deposited in the delivery tray 6.

Each one of the marking materials for use in the printing assembly are stored in four containers 5 arranged in fluid connection with the respective print heads for supplying marking material to said print heads.

The local user interface unit 8 is integrated to the print engine and may comprise a display unit and a control panel. Alternatively, the control panel may be integrated in the display unit, for example in the form of a touch-screen control panel. The local user interface unit 8 is connected to a control unit 7 placed inside the printing apparatus 1. The control unit 7, for example a computer, comprises a processor adapted to issue commands to the print engine, for example for controlling the print process. The image forming apparatus 1 may optionally be connected to a network N. The connection to the network N is diagrammatically shown in the form of a cable 9, but nevertheless, the connection could be wireless. The image forming apparatus 1 may receive printing jobs via the network. Further, optionally, the controller of the printer may be provided with a USB port, so printing jobs may be sent to the printer via this USB port.

FIG. 1B shows an ink jet printing assembly 10. The ink jet printing assembly 10 comprises supporting means for supporting an image receiving member 3. The supporting means 11 are shown in FIG. 1B as a platen 11, but alternatively, the supporting means 11 may be a flat surface. The platen 11, as depicted in FIG. 1B, is a rotatable drum 11, which is rotatable about its axis as indicated by arrow A. The supporting means 11 may be optionally provided with suction holes for holding the image receiving member 3 in a fixed position with respect to the supporting means 11. The inkjet printing assembly 10 comprises print heads 12*a*-12*d*, mounted on a scanning print carriage 13. The scanning print carriage 13 is guided by suitable guiding means 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the image receiving member 3. The platen 11, the carriage 13 and the print heads 12*a*-12*d* are controlled by suitable controlling means 18*a*, 18*b* and 18*c*, respectively.

The image receiving member 3 may be a medium in web or in sheet form and may be composed of e.g. paper, cardboard, label stock, coated paper, plastic, canvas, film or textile. Alternatively, the image receiving member 3 may also be an intermediate member, endless or not. Examples of endless members, which may be moved cyclically, are a belt or a drum. The image receiving member 3 is moved in the sub-scanning direction A by the platen 11 along four print heads 12*a*-12*d* provided with a fluid marking material. A scanning print carriage 13 carries the four print heads 12*a*-12*d* and may be moved in reciprocation in the main scanning direction B parallel to the platen 11, such as to enable scanning of the image receiving member 3 in the main scanning direction B. Only four print heads 12*a*-12*d* are depicted for demonstrating the invention. In practice an arbitrary number of print heads may be employed. In any case, at least one print head 12*a*-12*d* per color of marking material is placed on the scanning print carriage 13. For example, for a black-and-white printer, at least one print head 12*a*-12*d*, usually containing black marking material is present. Alternatively, a black-and-white printer may comprise a white marking material, which is to be applied on a black image-receiving member 3. For a full-color printer, containing multiple colors, at least one print head 12*a*-12*d* for each of the colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guiding means 14, 15. These guiding means 14, 15 may be rods as depicted in FIG. 1B. The rods may be driven by suitable driving means (not shown). Alternatively, the carriage 13 may be guided by other guiding means, such as an arm being able to move the carriage 13. Another alternative is to move the image receiving material 3 in the main scanning direction B.

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print zone, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the image receiving member 3. Therefore, it may be advantageous to remove excess of ink from the orifice surface 16. The excess of ink may be removed for example by wiping with a wiper and/or by application of a suitable anti-wetting property of the surface, e.g. provided by a coating.

Figure 2B:
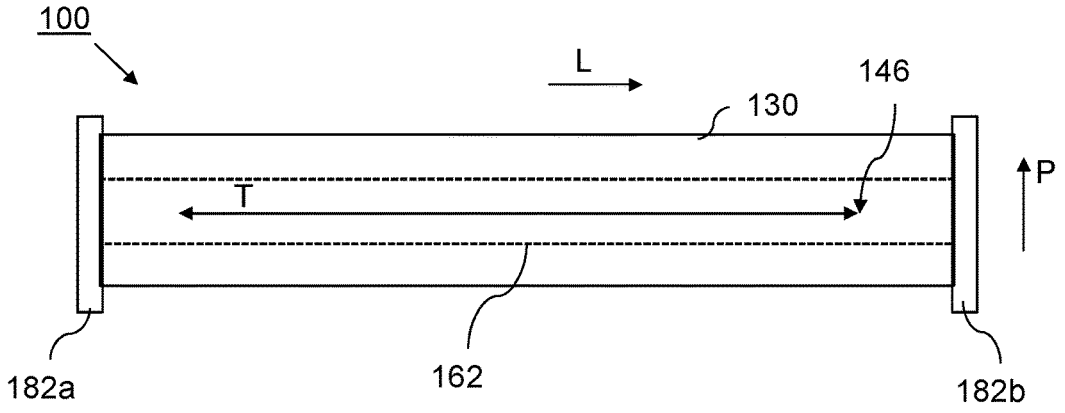

FIGS. 2A and 2B show schematically an embodiment of an assembly for moving a carriage according to the present invention. The assembly 100 may be used in a printing apparatus 1 shown in FIGS. 1A-1B.

FIG. 2A shows a side view of the assembly 100. FIG. 2B shows a plane view on the assembly 100. The assembly 100 comprises a carriage beam 130 arranged for supporting the carriage 120. The carriage 120 is moveably arranged along the carriage beam 130 along a longitudinal direction L of the carriage beam 130. The longitudinal direction L may extend along a scanning direction B as shown in FIG. 1B.

The assembly 100 further comprises a cable carrier 140 for supporting a cable 150 and a flexible support element 160. The cable carrier 140 is attached to the carriage 120 at a first end 144 of the cable carrier 140. The cable carrier 140 comprises a plurality of carrier segments 142, which are distributed along a length C of the cable carrier 140. Each of the carrier segments 142 is connected to a neighboring carrier segment 142 along the length C of the cable carrier 140.

The carrier segments 142 comprise a solid body having a shape for accommodating the cable 150 (or alternatively accommodating a plurality of cables 150). The cable 150 comprises at least one wire for communicating electrical power and/or electrical signals provided by a control unit 124 to the carriage 120. Alternatively or additionally the cable 150 may comprise a tube for communicating a fluid or a gas towards the carrier 120. The cable carrier 140 is arranged co-extensive to the cable 150 along a length direction of the cable 150 by accommodating the cable 150 along the length C of the cable carrier 140. In any way, the control unit 124 is operatively connected to the carriage 120 by way of the cable 150. The control unit 124 is additionally operatively connected by way of the cable 150 to a processing unit 122, which is mounted on the carriage 120.

Each of the carrier segments 142 further comprises two connecting portions, such as a hinge, to connect the carrier segments 142 to another, adjacent, carrier segment 142 along the length C of the cable carrier 140. The hinges support a rotation of a first carrier segment 142 with respect to a second carrier segment 142 around a pivot axis provided by a pivot pin of the hinge. As such, the connecting portions provide flexibility to the plurality of carrier segments 142 for bending the cable carrier 140. Each of the carrier segments 142, including the body and the connecting portions, is configured to substantially restrict a movement of the cable carrier 140 in a transverse direction P perpendicular to the longitudinal direction L of the carriage beam 130. The body is made of a relatively stiff material, such as a metal or a stiff plastic material. As such, the plurality of carrier segments 142 is configured to restrict a rocking movement of the cable carrier in the transverse direction P perpendicular to the carriage beam 130.

The cable carrier 140 is supported by the flexible support element 160, which is constituted by a metal belt 162, along the longitudinal direction L of the carriage beam 130. The metal belt 162 is mounted on a frame 180, i.e. is mounted at a first end 164*a* of the metal belt 162 along the longitudinal direction L by a first mounting plate 182*a* of the frame 180 and is mounted at a second end 164*b* of the metal belt 162 along the longitudinal direction L by a second mounting plate 182*b* of the frame 180. A first holder may be provided on the frame 180 for holding the first end 164*a* of the metal belt 162 as well as a second holder on an opposing side of the frame 180 for holding the second end 164*a* of the metal belt 162. The holders may comprise grippers, clamps, or any other type of fastening means.

The cable carrier 140 is attached to the metal belt 162 at a second end 146 of the cable carrier 140, which is attached at a connecting point arranged off-centered relative to the carrier beam along the longitudinal direction L. The cable carrier 140 is supported by the metal belt 162 along a track T (see FIG. 2B). Said track T extends from the fixed position of the second end 146 of the cable carrier 140 substantially parallel to the longitudinal direction L of the carriage beam 130 up to a loop of the cable carrier 140, where the cable carrier 140 is curved upward away from the metal belt 162. When the carriage 120 is moved along the carriage beam 130 in the direction L, the carrier segments 142 of the cable carrier 140 are in rolling contact to the metal belt 162 along the track T, thereby successively contacting the metal belt 162. The track T may be extended and shortened depending on the movement of the carrier 120 along the carriage beam 130.

The first end 144 of the cable carrier 140 moves along with the carriage 120 by suitably bending the cable carrier 140 in the looping shape (as shown in FIG. 2A). When the cable carrier 140 is in moving contact to the metal belt 162, the carrier segments 142 may generate a dynamic vibration inside the cable carrier 140 and inside the metal belt 162, such as in response to mechanical properties of the carrier segments 142 and/or in response to a velocity of the moving contact of the cable carrier 140 on the metal belt 162 along the track T.

In an alternative example (not shown), the connecting point of the second end 146 of the cable carrier 140 to the metal belt 162 is arranged substantially centered relative to the carrier beam along the longitudinal direction L, such that the cable carrier 140 may be in rolling contact to the metal belt 162 along a track T, which extends to both sides of the connecting point along the metal belt 162.

The metal belt 162 is mounted to the first mounting plate 182*a* of the frame 180 and to the second mounting plate 182*b* of the frame 180, wherein a compliancy of the metal belt 162 is controlled to damp a dynamic vibration caused by the moving contact of the plurality of carrier segments 142 to the metal belt 162. In particular, the material of the metal belt 162 is suitably selected and a tension is applied to the metal belt 162 along the track T, such that the compliancy of the metal belt 162 is configured for damping a dynamic vibration of the cable carrier.

In fact, by controlling the tension of the metal belt 162 along the track T, the flexibility of the metal belt 162 may suitably adjusted. The assembly 100 comprises a belt tensioning support bar 170 mounted to the first mounting plate 182*a* of the frame 180 and to the second mounting plate 182*b* of the frame 180. The belt tensioning support bar 170 is arranged coextensive to the metal belt 162 and is configured for maintaining the first mounting plate 182*a* and the second mounting plate 182*b* at a fixed distance between one another. In this way, a tension of the metal belt 162 along the track T is easily controlled. A compliancy of the metal belt 162 is easily adjusted by changing the tension of the metal belt 162 along the track T.

The attributes of the metal belt 162, such as a material and a shape, may suitably be selected based on predetermined dynamic vibration behavior of the cable carrier 140. In an example, when the carriage 120 is operated to move along the carriage beam 130 in a predetermined movement, having a known velocity during a reciprocating movement along the carriage beam 130, the dynamic vibration behavior of the cable carrier 140 may be determined (such as calculated) based on the predetermined movement. A compliancy of the metal belt 162 is selected based on the predetermined dynamic vibration, caused by the predetermined movement of the carriage 120. In particular a frequency response and/or a resonance amplitude of the metal belt 162 may be adapted to match the dynamic vibration of the cable carrier 140.

Figure 3A:
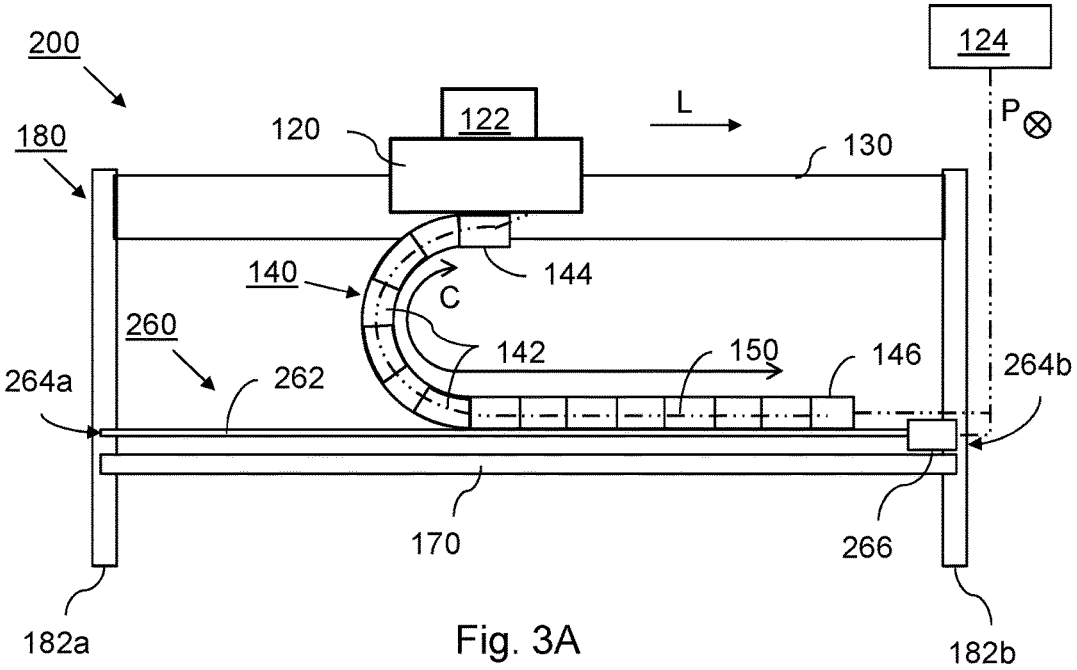
FIGS. 3A and 3B show schematically a modified embodiment of an assembly for moving a carriage according to the present invention.
Figure 3B:
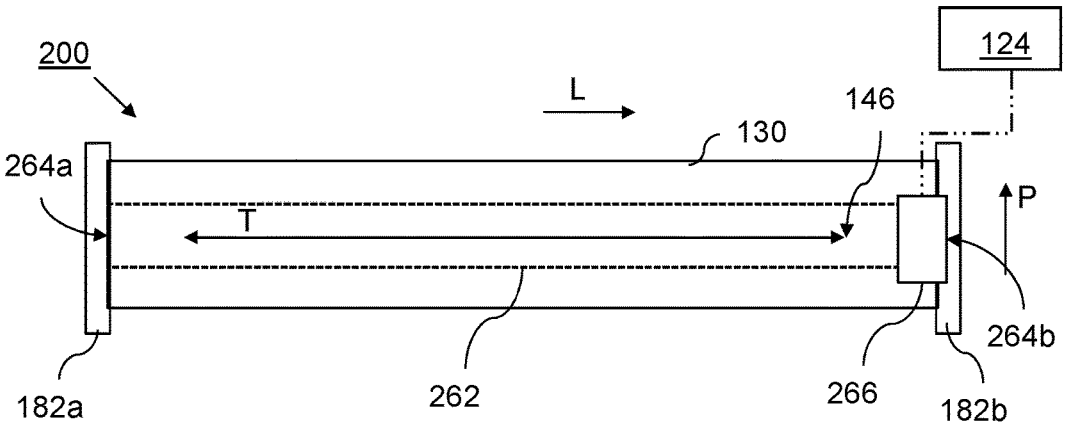

FIGS. 3A and 3B show schematically a modified embodiment of an assembly for moving a carriage according to the present invention. The assembly 200 may be used in a printing apparatus 1 shown in FIGS. 1A-1B.

FIG. 3A shows a side view of the assembly 200. FIG. 3B shows a plane view on the assembly 200. The assembly 200 has the same elements as the assembly 100 shown in FIG. 2A-2B. The assembly 200 comprises a modified flexible support element 260, which comprises a metal belt 262 and a tensioner assembly 266.

The cable carrier 140 is supported by the metal belt 262 along a track T (see FIG. 3B). Said track T extends from the fixed position of the second end 146 of the cable carrier 140 substantially parallel to the longitudinal direction L of the carriage beam 130 up to a loop of the cable carrier 140, where the cable carrier 140 is curved upward away from the metal belt 262. When the carriage 120 is moved along the carriage beam 130 in the direction L, the carrier segments 142 of the cable carrier 140 are in rolling contact to the metal belt 262 along the track T, thereby successively contacting the metal belt 262. The track T may be extended and shortened depending on the movement of the carrier 120 along the carriage beam 130.

The metal belt 262 is mounted on a frame 180, i.e. is mounted at a first end 264*a* of the metal belt 262 along the longitudinal direction L by a first mounting plate 182*a* of the frame 180 and is mounted at a second end 264*b* of the metal belt 262 along the longitudinal direction L via the tensioner assembly 266 to a second mounting plate 182*b* of the frame 180.

The tensioner assembly 266 is arranged for adjusting a tension of the metal belt 266. The tensioner assembly 266 comprises a number of springs, such as coil springs, connecting the second end 264*b* of the metal belt 262 to the second mounting plate 182*b* of the frame 180. The tensioner assembly 266 further comprises an adjusting mechanism operatively connected to the control unit 124 and configured for adjusting the spring force applied by the coil springs to the metal belt 262 to adjust the tension of the metal belt along the track T.

In particular, the control unit 124 controls the adjusting mechanism of the tensioner assembly to adjust the tension applied to the metal belt 262 along the track T, such that the compliancy of the metal belt 262 is adjusted for damping a dynamic vibration of the cable carrier. The control unit 124 adjusts the tension applied to the metal belt 262 along the track T, i.e. by controlling the adjusting mechanism, to affect a frequency response and/or a resonance amplitude of the metal belt 262.

In an example, the frequency response of the metal belt 262 may be increased or decreased by increasing or decreasing, respectively, the tension applied to the metal belt 262 along the track T. If the dynamic vibration $V_d$ caused by the cable carrier 140 contacting the metal belt 262 is substantially equal to an initial frequency response $F_0$ of the metal belt 262 ($V_d \approx F_0$), substantially no damping of the vibration is achieved. The frequency response of the metal belt 262 may be increased from $F_0$ to $F_1 >> V_d$ by increasing the tension applied to the metal belt 262 along the track T by the tensioner assembly 266. In this way, an improved damping of the dynamic vibration $V_d$ caused by the cable carrier 140 is achieved by the metal belt 262, and any transmission of the dynamic vibration $V_d$ to the carriage 120 via the frame 180 and the carriage beam 130 is prevented or at least reduced.

Alternatively, the frequency response of the metal belt 262 may be decreased from $F_0$ to $F_2 << V_d$ by decreasing the tension applied to the metal belt 262 along the track T by the tensioner assembly 266. In this way, an improved damping of the dynamic vibration $V_d$ caused by the cable carrier 140 is achieved by the metal belt 262, and any transmission of the dynamic vibration $V_d$ to the carriage 120 via the frame 180 and the carriage beam 130 is prevented or at least reduced.

Likewise, a resonance amplitude of the metal belt 262 at a given frequency may be adjusted by adjusting the tension of the metal belt 262.

As such, the compliancy of the metal belt 262 is adjustable by adjusting the tension of the metal belt 262. Adjusting the compliancy can be done easily in this embodiment and is advantageous by correcting for aging effects of the assembly 200, such as changing material properties of the cable carrier 140 or changing resilience properties of the flexible support element 262. Furthermore, the embodiment is advantageous for adjusting the compliancy to correct for changing dynamic vibrations of the cable carrier 140, such as due to different environmental conditions, e.g. different temperature or humidity.

Additionally, the control unit 124 is arranged to control the tension of the metal belt 262 by the tensioning mechanism 266 based on a movement of the carriage 120 along the carriage beam 130 in the direction L. The control unit 124 is operatively connected to a drive motor for moving the carriage 120 along the carriage beam 130 in the direction L. As the control unit 124 controls the movement of the carriage 120, the control unit may adjust the compliancy of the metal belt 262 (by changing the tension of the metal belt 262) based on an estimated or predetermined dynamic vibration of the cable carrier 140 based on the known movement of the carriage 120 along the carriage beam 130.

Figure 4:
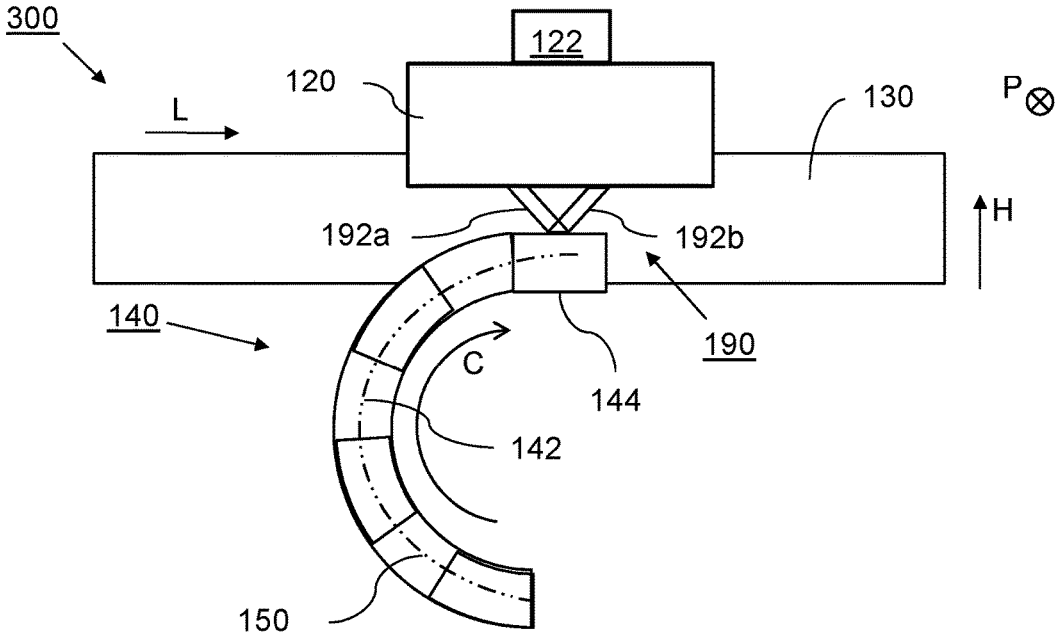
FIG. 4 shows an enlarged side view on a modified embodiment of an assembly for moving a carriage according to the present invention.

FIG. 4 shows an enlarged side view on a modified embodiment of an assembly for moving a carriage according to the present invention. The assembly 300 may be used in a printing apparatus 1 shown in FIGS. 1A-1B.

The assembly 300 has the same elements as the assembly 200 shown in FIG. 3A-3B. The assembly 300 comprises a modified connection of the cable carrier 140 to the carriage

120 at a first end 144 of the cable carrier 140. The assembly 300 comprises a spring assembly 190 comprising a first spring 192*a* and a second spring 192*b*, which are cooperatively arranged for mounting the first end 144 of the cable carrier 140. The first spring 192*a* and the second spring 192*b* are connected to the first end 144 of the cable carrier 140 at a common first position and arranged at an acute angle with respect to one another in a plane formed by the longitudinal direction L of the carriage beam 130 and a height direction H perpendicular to the direction L, wherein the acute angle is about 45 degrees in said plane. The spring assembly 190 provides mounting of the cable carrier 140 to the carriage 120, while at the same time damping any vibrations of the cable carrier 140 and damping any up-down motions in the height direction H or motions in the longitudinal direction L of the cable carrier 140.

Furthermore, the spring assembly 190 restricts a transmission of the dynamic vibration of the cable carrier 140 to the carriage 120 at its first end 144, which is mounted to the carriage 120.

Additionally, the spring assembly 190 may comprise a second pair of spring elements, arranged at an acute angle with respect to one another in a second plane formed by the longitudinal direction L of the carriage beam 130 and a height direction H perpendicular to the direction L, wherein the second plane of the second pair of spring elements is arranged parallel to the plane of the first spring 192*a* and the second spring 192*b*. In this way, additionally any side to side motions of the cable carrier 140 in a direction perpendicular to the respective plane is reduced (i.e. perpendicular to the plane of viewing in FIG. 4).

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An assembly for moving a carriage, the assembly comprising:

a carriage beam arranged for supporting the carriage, the carriage being moveably arranged along the carriage beam;

a cable carrier for supporting a cable, the cable carrier being attached to the carriage and comprising a plurality of carrier segments distributed along a longitudinal length of the cable carrier;

a flexible support element arranged along the carriage beam for supporting the cable carrier along a track, wherein when the carriage moves along the carriage beam, the cable carrier is in rolling contact to the flexible support element along the track, whereby the carrier segments successively contact the flexible support element; and a tensioner assembly arranged for tensioning the flexible support element, wherein a first end of the flexible support element is attached to a first mounting plate of a frame and a second end of the flexible support element is attached to a second mounting plate of the frame.

2. The assembly according to claim 1, wherein the tensioner assembly comprises a first and a second holder configured to hold the flexible support element and spaced apart from one another along a length of the flexible support element, such that the flexible support element is tensioned between the first and the second holder.

3. The assembly according to claim 2, wherein the flexible support element is a belt elastic in its longitudinal direction.

4. The assembly according to claim 2, wherein the tensioner assembly further comprises an adjusting mechanism for adjusting the tension in the flexible support.

5. The assembly according to claim 4, wherein the adjusting mechanism comprises positioning means for adjusting and setting a distance between the first and the second holder.

6. The assembly according to claim 4, wherein the adjusting mechanism comprises an adjusting spring element.

7. The assembly according to claim 1, wherein a first holder is mounted on the first mounting plate for holding the first end of the flexible support element and a second holder is mounted on the second mounting plate for holding the second end of the flexible support element.

8. The assembly according to claim 7, wherein the first holder and the second holder are mounted on opposite sides of the frame when viewed along a longitudinal direction of the carriage beam.

9. The assembly according to claim 1, wherein the assembly further comprises the cable and the cable carrier is arranged co-extensive to the cable along a length direction of the cable.

10. The assembly according to claim 1, wherein the cable carrier is connected to the carriage at a first end of the cable carrier and is connected to flexible support element at a second end of the cable carrier.

11. The assembly according to claim 1, wherein a compliancy of the flexible support element is configured for damping a dynamic vibration of the cable carrier.

12. The assembly according to claim 1, wherein the flexible support element is constituted by a metal belt element.

13. The assembly according to claim 1, wherein a compliancy of the flexible support element is adaptable by the tensioner assembly such to affect a resonance frequency and/or resonance amplitude of the flexible support element.

14. The assembly according to claim 1, wherein the assembly further comprises a control unit operatively connected to the tensioner assembly for controlling the tension of the flexible support element.

15. The assembly according to claim 14, wherein the control unit is arranged to control the tension of the flexible support element based on a movement of the carriage along the carriage beam.

16. The assembly according to claim 1, wherein the assembly further comprises at least one spring element arranged for mounting the cable carrier to the carriage.

17. The assembly according to claim 1, wherein the assembly further comprises two side mounting plates, each side mounting plate being arranged for mounting the carriage beam and arranged for mounting the flexible support element.

18. An apparatus comprising the assembly according to claim 1, wherein the apparatus comprises a processing unit which is mounted on the carriage and wherein the apparatus further comprises a control unit for controlling the processing unit by way of the cable.

19. The apparatus according to claim 18, wherein the apparatus is a printing apparatus and wherein the processing unit is a print head assembly for printing an image on a substrate.

* * * * *